United States Patent [19]

Williams

[11] 4,352,375

[45] Oct. 5, 1982

[54] CONTROL VALVES

[75] Inventor: Arthur J. Williams, Youngstown, Ohio

[73] Assignee: Commercial Shearing, Inc., Youngstown, Ohio

[21] Appl. No.: 140,173

[22] Filed: Apr. 14, 1980

[51] Int. Cl.[3] ..... F15B 13/08

[52] U.S. Cl. ..... 137/596.13; 91/451

[58] Field of Search ..... 91/451, 518; 137/596.13

[56] References Cited

U.S. PATENT DOCUMENTS

| | | | |
|---|---|---|---|
| 3,526,274 | 9/1970 | McMillen | 137/596.13 |
| 3,693,506 | 9/1972 | McMillen | 91/518 X |
| 3,718,159 | 2/1973 | Tennis | 137/596.13 X |
| 3,777,773 | 12/1973 | Tolbert | 137/596.13 X |
| 3,937,129 | 2/1976 | Miller | 137/596.13 X |
| 4,037,410 | 7/1977 | Jackson et al. | 60/452 X |

*Primary Examiner*—Gerald A. Michalsky

*Attorney, Agent, or Firm*—Buell, Blenko, Ziesenheim & Beck

[57] ABSTRACT

A control valve bank is provided having a working section and an inlet section wherein inlet fluid from a pump is proportionally metered at the inlet of each valve section so that the input volume to each work port is generally uniform regardless of pressure variations.

16 Claims, 8 Drawing Figures

CONTROL VALVES

This invention relates to pressure compensated control valves and particularly to a valve bank including a compensated pressure control valve section and an inlet section which is pressure compensating.

Control valves for use in mobile equipment such as backhoes, highlifts and the like have long been known and used. The trend has been over the years for constantly higher pressures coupled with a demand for smooth proportional metering control over a wide band of operating pressures. Simultaneous operation of two or more motors or cylinders from one pump, through one valve bank is another desired metering control function. While it would appear to be simple to split the available pump output between two or more motors or cylinders, it is in fact quite difficult and requires a special operator talent to properly split the flow and requires very precise and small valve spool adjustments, in the neighborhood of 3/32" or less, to avoid getting too much or too little volume to the required work operations.

I have invented a control valve bank including a working section and an inlet section which eliminates these problems. In this invention I provide a new concept in control valve bank assemblies in which the pump flow is metered at the inlet of each valve bank assembly and in which proportional flow and stroke changes are readily possible with little variations due to pressure. When simultaneous operations of more than one control valve working section is required, the operation is simple because proportional metering regulates the input volume to each work port at a generally uniform movement regardless of the pressure variations.

I provide in a multiple section control valve bank a valve working section and an inlet section that are operatively connected to provide smooth proportional metering control over a wide band of operating pressures and simultaneous metering operation of two or more fluid actuated devices from a single fluid pressure source, said control valve working section having a pressure inlet port, a pressure inlet chamber spaced from and connected to said ports, first and second work chambers having ports adapted to be connected to a fluid actuated device and spaced on opposite sides of the inlet chamber, first and second exhaust chambers having ports on opposite sides of said work chambers from the inlet chamber, a pair of metering and logic chambers with one chamber of said pair on each side of the inlet chamber between the inlet and the work chamber, a bore extending through the interconnecting all of said chambers, a valve element movable in said bore from a neutral position to first and second work positions for selectively connecting said chambers and establishing fluid communication therebetween whereby in a work position fluid flows from the inlet port through said pair of metering and logic chambers to one of said work ports, said inlet section having an inlet port adapted to be connected to a source fluid pressure, an outlet port connected to a valve section inlet port and in continuous communication with said inlet port of the inlet section, an exhaust port, a spaced by-pass port connected to said exhaust port, a signal port between said exhaust port and by-pass port, a bore extendng through and connecting said ports in said inlet section, a valve member movable in said bore between said signal port and by-pass port effective to control fluid communicating from the inlet to the outlet port of the inlet section and being movable to a by-pass position by-passing fluid from the inlet through the by-pass port to said exhaust port, biasing means opposing the movement of said valve member to said by-pass position, a connection between said outlet port of said inlet section and said inlet port of said control valve section delivering fluid therebetween, logic means connecting the signal port of said inlet section and a logic chamber of said control valve whereby the pressure in said signal port is varied in accordance with the difference between the pressure in the inlet port of the inlet section and the fluid pressure at said logic chamber to vary the biasing means opposing movement of said inlet section valve member whereby the flow of fluid from the inlet port to the outlet port of the inlet section is varied. Preferably, the inlet section includes piston means in the inlet section bore positioned for limited movement, means communicating through the piston from the signal port to the bore whereby pressure variations in said signal port causes said piston to move in the bore to vary the biasing means. The biasing means preferably includes resilient means between the piston and valve member in the inlet section bore normally urging them apart. Preferably, at least one pair of combination metering and logic chambers in the working section are connected together and to the inlet port by a bore spaced from and generally alongside the main bore. A combined pressure compensated flow control and transition check valve is preferably placed between the inlet chamber and the inlet port. This valve closes the connection from the inlet port to the inlet chamber and to the metering and logic chambers and by-passes fluid to the next succeeding valve or divides the flow of fluid between the inlet port and the next succeeding valve is provided in the inlet port of the working section. The logic means preferably includes a fluid actuated valve means in the working section having two control inlet ports, one communicating with the outlet and the other to the logic port of the working section and a control signal outlet port connected to the signal port of said inlet section. Preferably, I provide a heart-shaped passage from the combined flow control and transition check valve to the inlet chamber.

In the foregoing general description of my invention I have set out certain objects, purposes and advantages of the invention. Other objects, purposes and advantages will be apparent from a consideration of the following description and the accompanying drawings in which.

Figure 1:
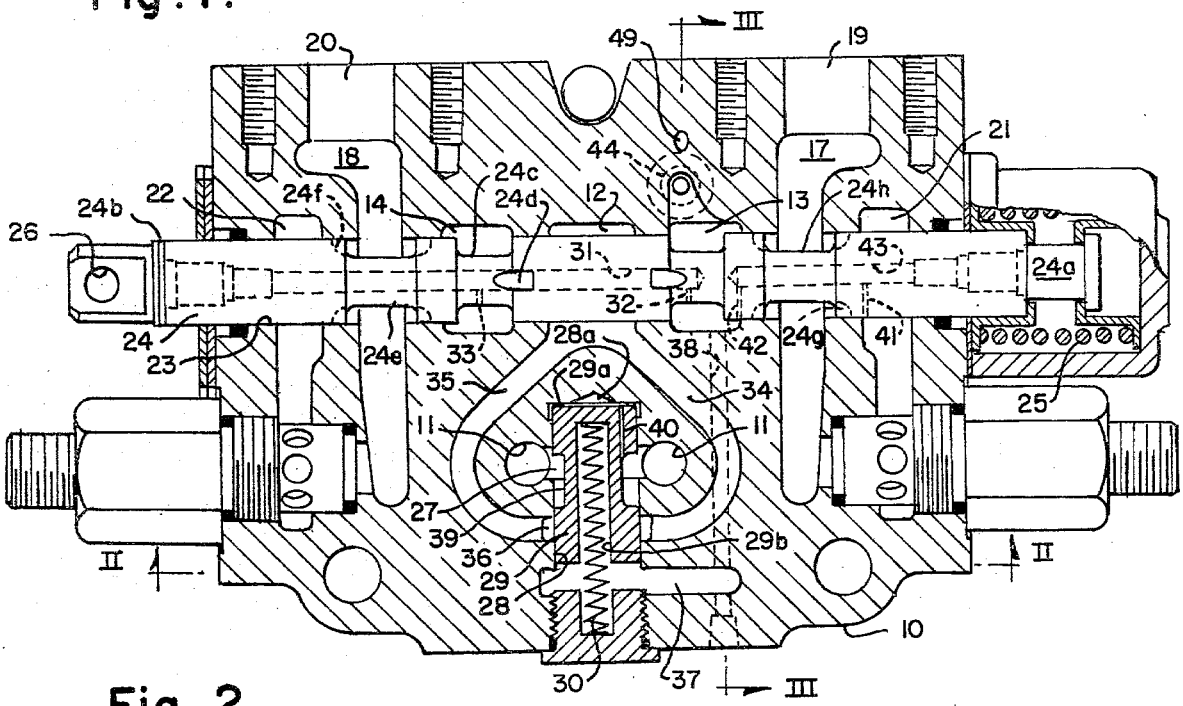
FIG. 1 is a longitudinal section through a control valve section according to this invention.

Referring to the drawings I have illustrated a control valve working section according to my invention in FIG. 1 having a housing 10 with a pair of inlet ports 11, an inlet chamber 12, a pair of metering and logic chambers 13 and 14 on opposite sides of the inlet chamber, a pair of work chambers 17 and 18 with work ports 19 and 20 on opposite sides of the metering and logic chambers 13 and 14 and finally a pair of exhaust chambers 21 and 22 on opposite sides of the work chambers 17 and 18. An elongate bore 23 extends through housing 10 intersecting all of chambers 12–14, 17, 18, 21 and 22. Valve member or spool 24 extends through bore 23 and out of the housing 10 at both ends. One end 24*a* is provided with a conventional centering mechanism 25. The other end 24*b* is provided with an eye 26 for a hand control lever (not shown) of conventional design. The inlet ports 11 connect with an annular chamber 27 which communicates with a bore 28 extending transversely to and spaced from bore 23. Bore 28 is provided with a combination transition check and compensating valve spool 29. The combined check and compensating valve 29 is normally urged to the closed position by a spring 30. The two metering chambers 13 and 14 are connected by an axial passage 31 extending through a portion of spool 24 and transverse passage 32 and 33 extending to the exterior of the spool. A bifurcated heart-shaped passage 34–35 extend from inlet chamber 12 to an annular chamber 36 intersecting bore 28 spaced from chamber 27 and surrounding valve 29. As indicated above, one end 29*a* of spool 29 is urged against the end of bore 28 by spring 30. The other end of spool 29 is hollow and has an axial bore 29*b* which carries the spring 36 and is open to a chamber 37 at the end of a passage 38 which connects chamber 37 with metering and logic chamber 13. Spool 29 is provided with an external annular groove 39 intermediate its ends. A passage 40 extends through the body of spool 29 from groove 39 to the end 29*a* of spool 29 to provide constant communication between bore 28 above valve spool 29 and heart-shaped passage 34–35. Spool 24 is provided with spaced apart transverse passages 41 and 42 which intersect axial passage 43 to connect metering and logic chamber 13 with exhaust port 21 when spool 24 is in the neutral position. In all other positions communication is shut off by the adjacent lands of the housing. Logic chamber 13 connects to a fluid actuated valve passage 44 having valve seats 45 and 46 at each end and an intermediate movable check member 47 such as a ball which can move from one seat to the other dependent upon pressure flow. An intermediate outlet port 48 connects to a by-pass line 49 which connects with a like passage 44 in the next adjacent valve through like seat 45.

I also provide an inlet section having a housing 50 with an inlet port 51 connected to an outlet chamber 52 and an outlet port 53 connected to the same outlet chamber. A by-pass chamber 54 is spaced from said outlet chamber 52 along with a signal chamber 55 on the opposite side of said by-pass chamber 54 from the outlet chamber. A pair of exhaust chambers 56 and 57 are placed on opposite sides of all of the chambers and are connected together by a passage 58 which also intersects by-pass chamber 54. Signal passage 55 has a signal port 59 which connects with passage 49 of the working valve section 10. A bore 60 extends lengthwise of housing 50 through all of chambers 52, 54, 56 and 57 and carries, intermediate its ends, a valve spool 61 which has axial bores 62 and 63 at its opposite ends and an annular groove 64 intermediate its ends. A transverse passage 62*a* through the wall of spool 61 provides communication from outlet chamber 52 into axial bore 62. A piston 65 is movable in the end of bore 60 adjacent bore 63 and is provided with an axial bore 66 which is open at the end adjacent bore 63 and carries spring 67 which extends into bore 63 and urges the piston 65 and spool 61 apart. The bore 66 terminates short of the end of piston 65 leaving a head 65*a* which has an opening 65*b* therethrough into the end of bore 60. Piston 65 has a shoulder 68 which limits its movement toward signal chamber 55 so that it cannot close chamber 55. Spool 61 has a transverse passage 63*a* through its wall into bore 63 which is normally closed by the wall of bore 60 but when spool 61 is moved to the right against spring 67 it opens to signal chamber 55.

Figure 2:
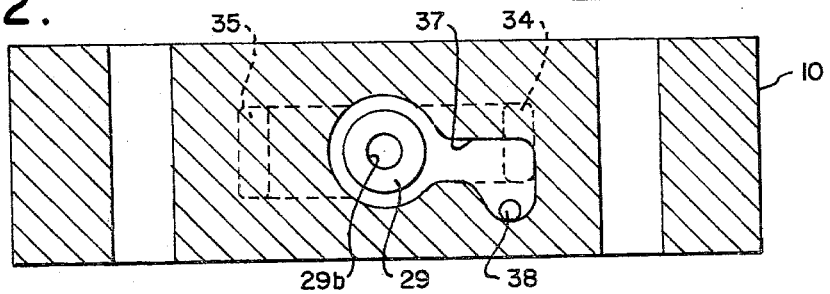
FIG. 2 is a section on the line II—II of FIG. 1.
Figure 4:
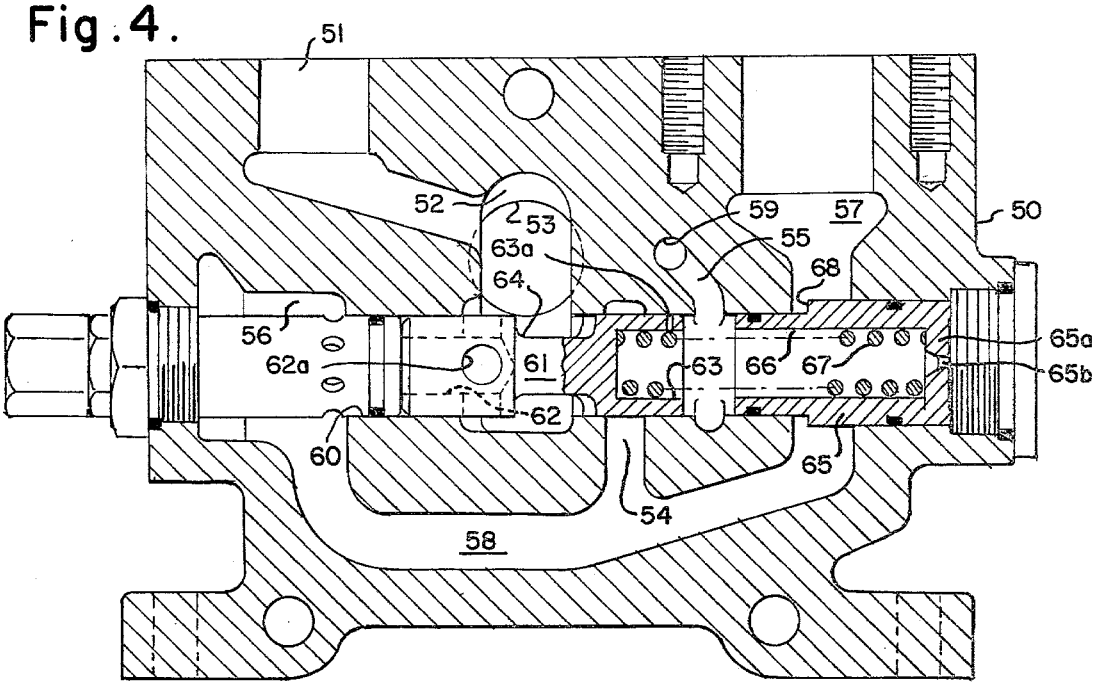
FIG. 4 is a longitudinal section through an inlet section according to this invention.
Figure 5:
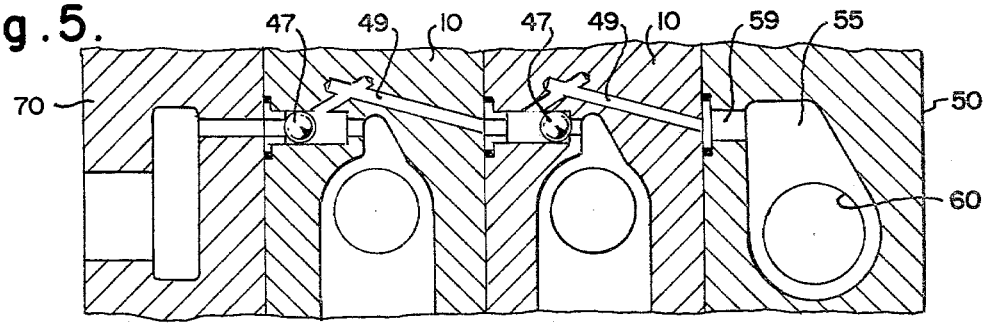
FIG. 5 is a transverse section through a bank of control valves according to this invention including an inlet section of this invention and an outlet section.

In operation inlet section housing 50 is assembled with one or more working section housings 10 and an outlet section 70 as illustrated in FIG. 5. So assembled, outlet port 53 of the inlet section 50 is aligned with inlet port 11 of working section 10 so that fluid entering inlet port 51 passes through chamber 52, through outlet port 53 to inlet port 11, chamber 27 and passage 40 where it moves combination compensation and check spool 29 downwardly, viewing FIG. 2, to divide the fluid through passages 34–35 into chamber 12 and then into the inlet port 11 of the next succeeding valve. Fluid in chamber 27 passes through passage 40 into chamber 28*a* pressurizing the end of valve 29 to urge it downwardly against spring 30. When the spool 24 is moved to a working position, as for example to the right in FIG. 1, fluid in chamber 12 flows first through metering slots 24*d* around annular groove 24*c* into meter and logic chamber 14, around annular groove 24*e*, through metering slots 24*f* into work chamber 18 where it proceeds through port 20 to the motor being driven. At the same time, a portion passes through passages 31, 32 and 33 into chamber 13 through passage 38 to chamber 37 where it acts on the bottom end of spool 29 in opposition to the inlet pressure in chamber 28*a* and on the signal port 46 and there to signal port 55. On the other end of spool 24 metering slots 24*g* and groove 24*h* return fluid from a motor (not shown) to exhaust chamber 21 from work port 19 and chamber 17. At the same time, inlet fluid flows through valve seat 46 to force check ball 47 to the left (viewing FIGS. 3 and 5) against seat 45 and out passage 49 to inlet 59 and signal chamber 55 of inlet section 50 where it pressurizes bores 63 and 66 and passes through passage 65*b* to urge piston 65 leftward, viewing FIG. 4 to hold valve spool 61 in the position shown in FIG. 4 to prevent by-passing any fluid through chamber 54.

As spool 24 is moved right, the groove 24*c* connects chamber 12 with chamber 14 for the maximum flow as does groove 24*e* also connect chambers 18 and 14, permitting maximum flow to work port 20. The length and size of metering grooves 24*d* control the input to either work port by telling the flow control spool 29 to permit proportional flow input changes at a constant predetermined pressure differential on the spool end chambers 28*a* and 37. In the neutral position logic chamber 13 is vented to exhaust 21 through transverse passages 41 and 42 and axial passage 43. The vent passages are arranged so that a very small movement of spool 24 to the right or left will close passage 41 or 42 and thus terminate venting of logic chamber 13 to exhaust chamber 21. If the spool 24 of another work section 10 in the valve bank is actuated to feed another motor operating at a lower pressure, then combination pressure compensated and check valve 29 of the higher pressure valve will close and act as a check to prevent back flow from the work port of the higher pressure function valve. In short, the valve 29 is a check valve to close under the pressure of spring 30 if the pressure in chamber 12 is greater than the pressure at the inlet port 11.

When the pressure in metering and logic chamber 13 drops below the pressure in chamber 12, the compensated flow control spool 29 moves downwardly, viewing FIG. 1, due to pressure in chamber 28*a* forcing the spool downwardly against the reduced pressure in chamber 37.

Similarly, if the pressure in metering and logic chamber 13 of any spool drops below the pressure in any spool in the system the ball check 47 of that valve moves to the right, viewing FIGS. 3 and 5, permitting flow through port 46, through output port 48 and passsage 49 to signal chamber 55 of the input section. If the pressure in logic passage 44, 49 of all of the valves in the bank drops below the input pressure, then the pressure in signal chamber 55 drops and spool 61 moves to the right, viewing FIG. 4, by-passing input fluid from chamber 52 around groove 64, through bore 60 into by-pass chamber 54 and from thence to exhaust chamber 57.

Figure 6:
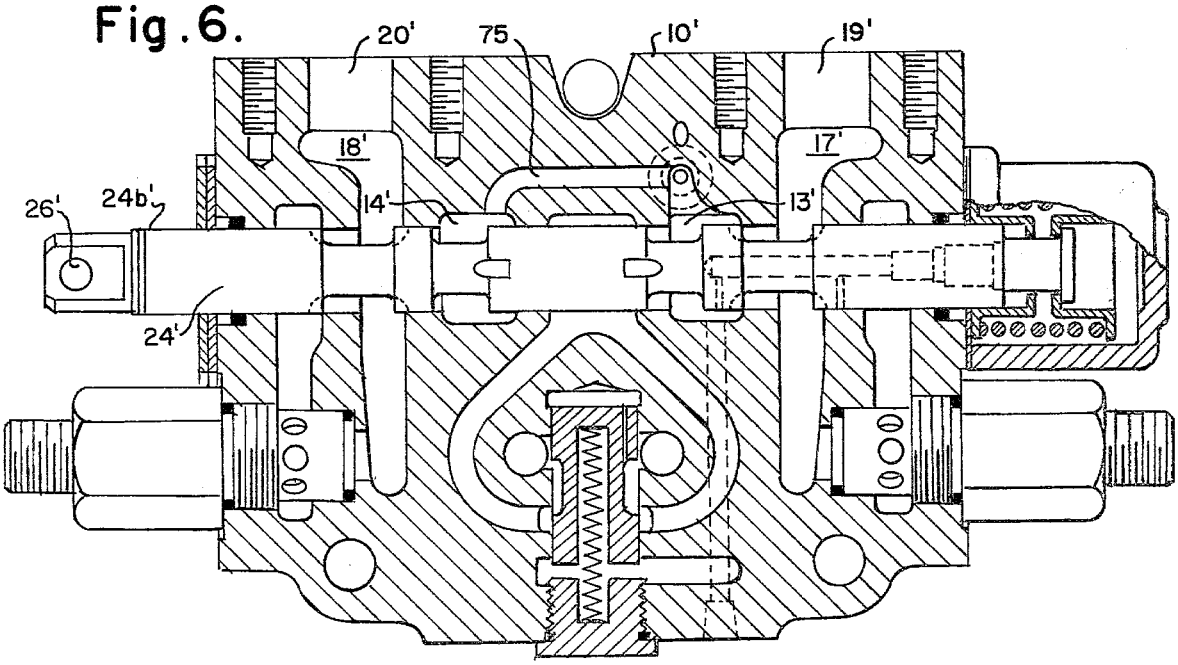
FIG. 6 is a longitudinal section of a second embodiment of control working valve section according to this invention.

In FIG. 6 I have illustrated an identical valve structure as in FIGS. 1 through 5 except for the use of a cored passage 75 in the body of the control valve to connect chambers 13' and 14' instead of axial passage 31 and transverse passage 32 in spool 24 of FIG. 1. All like parts are identified by like numbers with a prime sign. The operation of this second embodiment is precisely the same as the first embodiment of FIGS. 1–5 except for the substitution of passage 75 as described above.

Figure 3:
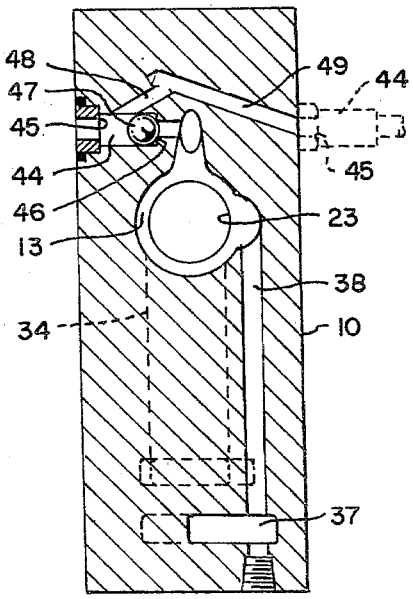
FIG. 3 is a fragmentary section on the line III—III of FIG. 1.
Figure 7:
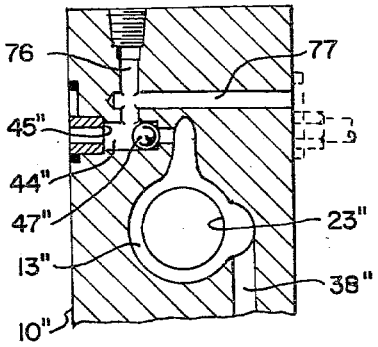
FIG. 7 is a fragmentary section of a second embodiment of logic check arrangement for the control working valve section according to this invention.

In FIG. 7 I have illustrated a second embodiment of logic check arrangement in which passages 76 and 77 take the place of passage 49 of FIG. 3 from passage 44" to the inlet port 45" of the next valve. All other like parts are given like numbers with a double prime sign.

Figure 8:
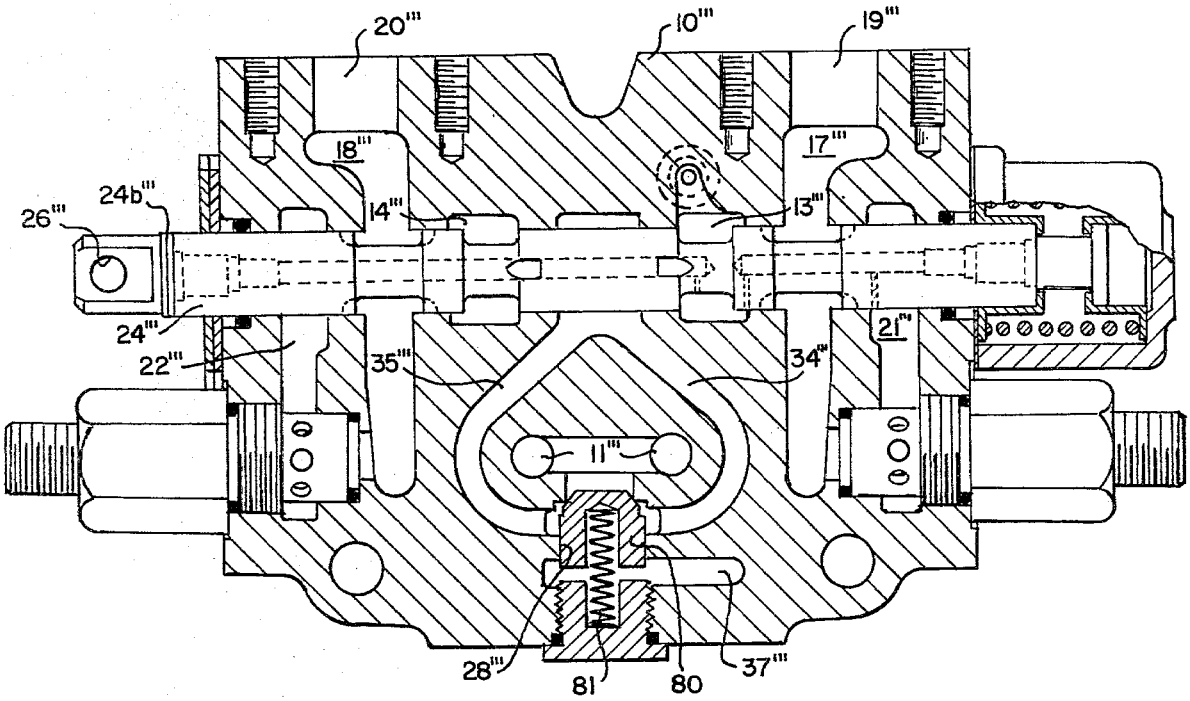
FIG. 8 is a longitudinal section of a third embodiment of control working valve section according to this invention.

FIG. 8 illustrates a third embodiment of control valve 10''' in which those parts which are common to like parts in the embodiment of FIG. 1 are given like numbers with a triple prime sign. This structure differs from that of FIG. 1 in eliminating the combination pressure compensating and check spool 29 and passage 38 and substituting therefor check valve 80 with biasing spring 81 instead of spring 30 and the elimination of passage 38. The valve of FIG. 8 is thus not individually pressure compensated as are the valves of FIGS. 1 through 6.

In the foregoing specification I have set out certain preferred practices and embodiments of my invention; however, it will be understood that this invention may be otherwise embodied within the scope of the following claims.

I claim:

1. In a multiple section control valve bank, a control valve working section and an inlet section that are operatively connected to provide smooth proportional metering control over a wide band of operating pressures and simultaneous metering operation of two or more fluid actuated devices from a single fluid pressure source, said control valve working section having a pressure fluid inlet port, a pressure inlet chamber spaced from and connected to said inlet port, check valve means between said inlet port and inlet chamber, first and second work ports adapted to be connected to a fluid actuated device, first and second work chambers connected to said ports and spaced on opposite sides of said inlet chamber, first and second exhaust chambers on opposite sides of said work chambers from the inlet chamber, a pair of metering and logic chambers with one chamber on each side of the inlet chamber between the inlet chamber and the work chambers, a main bore extending through and interconnecting all of said chambers, a valve element movable in said bore from a neutral position to first and second work positions for selectively connecting said chambers and establishing fluid communication therebetween whereby in a work position fluid flows from the inlet port through said metering and logic chambers to one of said work ports, said inlet section having an inlet port adapted to be connected to a source of fluid pressure, an outlet port and chamber connected to said inlet port and to a valve section inlet port, an exhaust port, a spaced by-pass chamber connected to said exhaust port, and a signal chamber between said exhaust port and by-pass chamber, a bore extending through and connecting said chambers in said inlet section, a valve member movable in said bore between said signal chamber and said by-pass chamber effective to control fluid communicating from the inlet to the outlet port and being movable to a by-pass position by-passing fluid from the inlet through the by-pass chamber to said exhaust port, biasing means opposing the movement of said valve member to said by-pass position, a connection between said outlet port of said inlet section and said inlet port of said control valve section delivering fluid therebetween, logic means connecting the signal chamber of said inlet section and a metering and logic chamber of said control valve whereby the pressure in said signal chamber is varied in accordance with the difference between the pressure in the inlet port of the inlet section and the fluid pressure at said metering and logic chamber to vary the biasing means opposing movement of said inlet section valve member whereby the flow of fluid from the inlet port to the outlet port of the inlet section is varied by by-passsing fluid.

2. A control valve bank section including a working section and inlet section as claimed in claim 1 wherein the inlet section includes piston means in said bore positioned for limited movement therein, means communicating through said piston from said signal chamber to said bore whereby pressure variations in said signal chamber causes said piston to move in the bore to vary the biasing means.

3. A control valve bank as claimed in claim 2 wherein the biasing means includes resilient means between said piston and valve member normally urging them apart.

4. A control valve bank as claimed in claim 1 or 2 or 3 wherein the pair of metering and logic chambers in the working section are connected together and to a bore spaced from and generally parallel to the main bore.

5. A control valve bank as claimed in claim 4 wherein the pair of metering and logic chambers are connected together by an axial bore and intersecting transverse passsages in the working section valve element.

6. A control valve bank as claimed in claim 4 wherein the pair of metering and logic chambers are connected by a passage in the body of the control valve working section.

7. A control valve bank as claimed in claim 4 wherein the valve element in the working section has a generally axial passage connecting transverse passages communicating through the valve element wall with at least one logic chamber and an exhaust port in the neutral position.

8. A control valve bank as claimed in claim 4 wherein the valve element in the working section has in the neutral position a reduced diameter at each of the metering and logic chambers and each of the working chambers and metering slots of pre-selected length extending on the surface thereof in each direction from each said reduced diameter portion.

9. A control valve bank as claimed in claim 1 or 2 or 3 wherein the logic means includes a fluid actuated valve means in the working section having two control signal inlet ports, one connected to an exhaust outlet and the other to a logic chamber, and a control signal outlet port intermediate the inlet ports connected to the signal port of said inlet section.

10. A control bank as claimed in claim 9 wherein the fluid actuated valve means is a three-port shuttle valve.

11. A control bank as claimed in claim 1 or 2 or 3 wherein the check valve is biased to the closed position by the combined pressure of resilient means and fluid pressure from the logic and metering chambers on one end and to the open position by fluid pressure from the inlet port on the other end whereby said check valve functions as a combined pressure compensating and check valve.

12. A control valve bank as claimed in claim 11 wherein the working section includes a fluid chamber surrounding the resilient means and communicating with said one end of the check valve and passage means connecting said fluid chamber with said metering and logic chambers.

13. A control valve bank as claimed in claim 12 wherein the valve element in the working section has a generally axial passage connecting transverse passages communicating through the valve element wall with at least one logic chamber and an exhaust port in the neutral position.

14. A control valve bank as claimed in claim 1 wherein the logic means includes a fluid actuated valve means in the working section having two control signal inlet ports, one connected to an exhaust outlet and the other to a logic chamber and a control signal outlet port intermediate the inlet ports connected to the signal port of said inlet section.

15. A control valve bank as claimed in claim 1 or 2 or 3 wherein the valve element in the working section has a generally axial passage connecting transverse passage communicating through the valve element wall with at least one logic chamber and an exhaust port in the neutral position.

16. A control valve bank as claimed in claim 1 or 2 or 3 wherein the valve element in the working section has in the neutral position a reduced diameter at each of the metering and logic chambers and each of the working chambers and metering slots of pre-selected length extending on the surface thereof in each direction from each said reduced diameter portion.

* * * * *

UNITED STATES PATENT AND TRADEMARK OFFICE

CERTIFICATE OF CORRECTION

PATENT NO. : 4,352,375

DATED : October 5, 1982

INVENTOR(S) : Arthur J. Williams

It is certified that error appears in the above-identified patent and that said Letters Patent are hereby corrected as shown below:

On the Title Page, the first reference cited "3,526,274" should read -- 3,526,247 --.

Column 1, line 21 "3/32" should read -- 1/32 --.

Column 4, line 1, -- 55 -- should be added after "54".

Signed and Sealed this

Eighth Day of March 1983

[SEAL]

*Attest:*

GERALD J. MOSSINGHOFF

*Attesting Officer*

*Commissioner of Patents and Trademarks*